United States Patent [19]

Plursch et al.

[11] 4,067,035

[45] Jan. 3, 1978

[54] DAYLIGHT DEVELOPING MACHINE

[75] Inventors: Gerald Plursch, Munich; Jürgen Leuchter, Tutzing, both of Germany

[73] Assignee: AGFA-Gevaert, AG, Leverkusen, Germany

[21] Appl. No.: 697,573

[22] Filed: June 18, 1976

[30] Foreign Application Priority Data

June 20, 1975 Germany ..... 2527561

[51] Int. Cl.[2] ..... G03D 3/13

[52] U.S. Cl. ..... 354/313; 354/316; 354/321

[58] Field of Search ..... 354/297, 312, 313, 314, 354/316, 319, 320, 321, 322; 134/64 P, 122 P

[56] References Cited

U.S. PATENT DOCUMENTS

| | | | |
|---|---|---|---|
| 1,946,841 | 2/1934 | Ybarrondo | 354/321 |
| 3,762,300 | 10/1973 | Hart et al. | 354/312 |

*Primary Examiner*—L. T. Hix
*Assistant Examiner*—Alan Mathews
*Attorney, Agent, or Firm*—Michael J. Striker

[57] ABSTRACT

A continuously operating developing machine includes, arranged one after the other, a first strip attachment station, an infeed accumulator, a second strip attachment station, at least one processing fluid stage, at least one drying stage, and a discharge station. Film strips and leader strips are transported through the processing fluid and drying stages to the discharge station along a predetermined path. When the trailing end of a strip which extends through the accumulator and has already entered the predetermined path reaches the first attachment station, it is detained at the latter and there is attached thereto the leading end of the next strip. During such detention, the accumulated strip inside the infeed accumulator feeds into the predetermined path. When the attachment operation is finished, the trailing end enters the accumulator and the amount of strip within the accumulator increases anew. When the strip in the accumulator breaks, the trailing end of the broken strip section as it is leaving the accumulator is engaged, and there is attached thereto the leading end of a leader strip. The trailing end of such broken strip section is then fed into the predetermined path with the leader strip attached thereto entering thereafter.

14 Claims, 2 Drawing Figures

DAYLIGHT DEVELOPING MACHINE

BACKGROUND OF THE INVENTION

The invention relates to daylight developing machines, wherein film to be developed is transported in succession through a film strip attachment station, an infeed accumulator, processing fluid stages, drying stages and to a discharge station.

In daylight developing machines of the general type referred to above, it is now common to develop not only motion-picture film, but also still photograph film strips from different customers connected together to form a long strip. A significant problem is the provision of splices between the individual film strips. These must be capable of passing through the developing, fixing and bleaching solutions without coming apart and, above all, must be capable of withstanding the mechanical stresses to which they are subjected in passing through the developing machine.

It is known to feed into a continuously operating developing machine a supply of leader strip when the developing machine is to be shut down. In this way, when the developing machine is to be started up again, it is merely necessary to connect the leading end of the next film strip to be developed to the trailing end of the leader strip already in the machine. As soon as the unconnected trailing end of a film strip to be developed has been pulled out of the film strip supply cassette, one attaches to such trailing end the leading end of either another film strip from another supply cassette or else the leading end of a leader strip.

The strips, on their way from the strip attachment station to the processing fluid stages, pass through an infeed accumulator. The infeed accumulator accumulates a certain length of strip, for example 6 to 10 meters, for subsequent feedout. Specifically, when the trailing end of a strip which extends through the infeed accumulator and which has already entered the first processing fluid stage arrives at the strip attachment station, it is detained there during the attachment thereto of the leading end of another strip. In order that the feeding of strip into the processing stages not be interrupted during such detention, the accumulated strip in the infeed accumulator is allowed to feed out into the processing stages. When the attachment operation is completed, the trailing end of the strip previously detained is permitted to enter into and pass through the infeed accumulator. Meanwhile, the accumulator begins to accumulate a certain length of strip again, in preparation for the next such attachment operation.

One such infeed accumulator is comprised of two rows of guide rollers about which the strip within the accumulator is trained in a winding path. The upper row of guide rollers is fixedly mounted, whereas the lower row of guide rollers is mounted on a vertically displaceable rod. During normal operation, i.e., when the infeed accumulator has accumulated its full length of strip, the lower row of guide rollers is at the bottom of the accumulator. If the trailing end of the strip in the accumulator is detained at the strip attachment station, the length of strip within the accumulator decreases; as the accumulated strip is fed out into the first processing stage, the rod mounting the lower row of guide rollers rises toward the upper row of guide rollers thereby shortening the path of the accumulated strip.

When developing connected-together film strips, it has been discovered that most strip breakage results from mechanical stresses to which the strips are subjected and above all from those stresses which result from the entrainment of the strips about small-diameter guide rollers. If a splice is of low quality or if a film strip has in it to begin with a small tear, the film strip will break when passing around such a roller as early as during the travel of the film strip through the infeed accumulator. In fact, the probability that the film strip breakage will occur within the infeed accumulator amounts to about 85–95%. When the strip breaks in this way, it is necessary to open up the infeed accumulator and rethread it. Because a daylight developing machine is involved, the entire length of film strip within the accumulator will become exposed. Typically the length involved will be from about 6 to 10 meters. To avoid exposure of so much of the film strip, it is possible to permit the section of film strip downstream of the break to continue to be fed into the processing stages of the developing machine, with the section of film strip upstream of the break being wound back out of the infeed accumulator into the film strip supply cassette. The disadvantage of this approach is that when the broken section of film strip has passed completely through the developing machine, although it has been saved from exposure and indeed has been properly developed, it is necessary to thread a leader into the developing machine, so that the feeding of film strips to be developed into the machine can resume. The threading of a leader into an unthreaded developing machine is time-consuming and therefore costly.

With conventional developing machines, it is usual to arrange the individual processing stages of the machine one after the other in a continuous straight path leading from one to the other end of the machine. This arrangement of processing stages has the disadvantage that the operator of the machine must continually run back and forth between the infeed and discharge ends of the machine. Federal Republic of Germany Offenlegungsschrift 2,021,119 discloses a machine for developing motion-picture film in which the processing stages are arranged in the just-described manner, but with the film after passing through the drying stages being guided in rearward direction to the back side of the machine. However, the disadvantage in question is not avoided, because here again two operators must be employed, one to work at the infeed station at the front side of the machine, the other to work at the discharge station at the back side of the machine.

Besides attending to the infeed and discharge of film strips, the operator of a developing machine of the type in question must attend to other machine operations and to machine malfunctions which, likewise, may require him to run back and forth between different parts of the machine. In particular, the machine operator must make sure that feeding of film strips into the processing stages proceeds in a proper manner after film strip breakage.

SUMMARY OF THE INVENTION

It is a general object of the invention to provide a daylight developing machine and a method of controlling the transport of film to be developed through the same such that the amount of film which becomes ruined as a result of film breakage can be kept as small as possible, with the work which must be performed by the operator of the machine at the same time being simplified.

This object, and others which will become more understandable from the description, below, of preferred embodiments, can be met, according to one advantageous concept of the invention, by making use of a developing machine which includes, arranged one after the other, a first strip attachment station, an infeed accumulator, a second strip attachment station, at least one processing fluid stage, at least one drying stage, and a discharge station. Film strips and leader strips are transported through the processing fluid and drying stages to the discharge station along a predetermined path. When the trailing end of a strip which extends through the accumulator and which has already entered the predetermined path has reached the first attachment station, it is detained at the latter, and there is attached thereto the leading end of the next strip. During such detention, the accumulated strip inside the infeed accumulator feeds into the predetermined path. When the attachment operation is finished, the trailing end enters the accumulator and a new accumulation of strip grows within the accumulator. When the strip in the accumulator breaks, the trailing end of the broken strip section as it is leaving the accumulator is engaged, and there is attached thereto the leading end of a leader strip. The trailing end of the broken strip section is then fed into the predetermined path with the leader strip attached thereto entering thereafter.

With this set-up, if a film strip breaks inside the infeed accumulator, the trailing end of the broken section continues to be transported to the second attachment station, and there has attached thereto the leading end of a leader strip. The dimensions of the second attachment station can be so selected that the length of film which might become ruined at this second attachment station would be no more than 10 to 20 centimeters.

Advantageously, the infeed accumulator can be provided with means for generating a warning signal immediately upon the occurrence of a film breakage within the accumulator. The operator of the machine is thereby alerted and can begin preparations for splicing a leader strip to the trailing end of the broken film strip section as the latter leaves the accumulator and enters the second attachment station; usually, a certain time will pass between the moment of actual strip breakage and the arrival of the trailing end of the broken strip section at the second attachment station. Once the trailing end of the broken strip section has actually arrived at the second attachment station, the machine can be shut down without danger of damage to (improper processing of) the film strip sections already in the processing stages, inasmuch as the time required for the actual splicing work is quite short.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
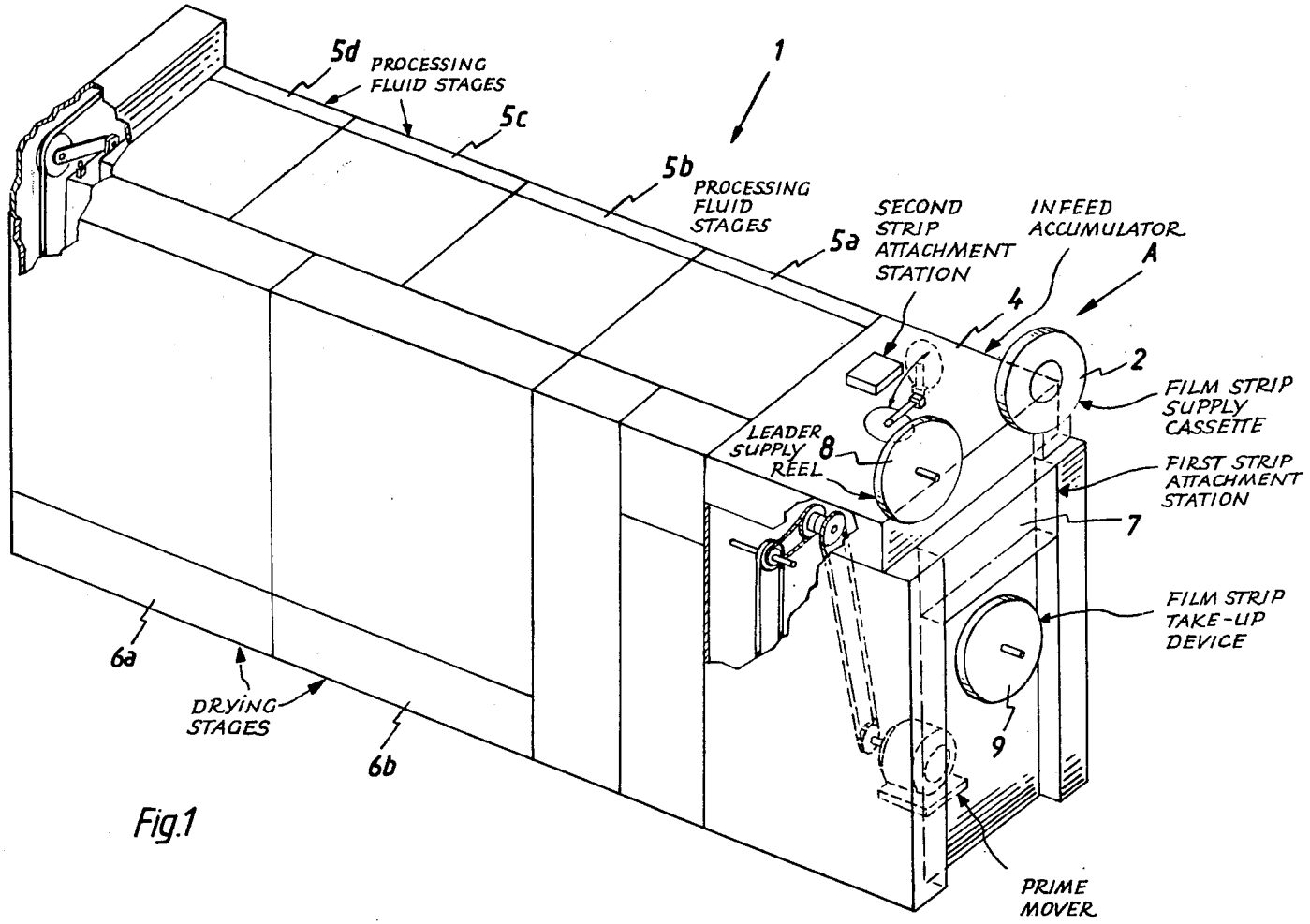
FIG. 1 is a perspective view of a daylight developing machine embodying concepts of the present invention.

In FIG. 1, numeral 1 denotes generally a daylight developing machine. The machine at its infeed station is provided with a cassette 2 containing film strips 3 to be developed. The lower side of cassette 2 is connected light-tight with an infeed accumulator 4, the latter being shown in greater detail in FIG. 2. Arranged downstream of the infeed accumulator 4 are successive processing fluid stages *5a–5d*. These stages together define one stretch of the winding film strip transport path, this stretch leading in direction from the end of the machine 1 provided with the infeed station to the other end of the machine. Alongside this first stretch is a second or return stretch leading from such other end of the machine back to the first end, this return stretch including a first drying stage *6a* and a second drying stage *6b*. In the space remaining between the second drying stage *6b* and the infeed accumulator 4 there can be arranged various devices having box-shaped housings, for example dosing arrangements for processing baths, an outfeed accumulator, electronic control devices for various machine components, etc.

The narrow end of the machine at which the cassette 2 is provided is additionally provided with a first strip attachment station 7, a leader strip supply reel 8 and a film strip take-up reel device 9 serving to collect the completely developed and dried film strips. The strip attachment station 7 is comprised of a light-tight chamber which can be opened and through which the film strip emerging from the closed cassette 2 passes on its way to the infeed accumulator 4. At this first strip attachment station 7, the operator effects the connection of a new strip to the trailing end of a strip which has entered the infeed accumulator 4.

Arranged in the vicinity of the first strip attachment station 7, the infeed accumulator 4 and the take-up reel device 9 of the discharge station is a (non-illustrated) control board provided with the controls by means of which the operator controls the operation of the developing machine 1. Thus, the operator, essentially without moving from the place at which he stands or is seated, can attend to both the infeed and discharge of film strips, can attend to film breakages within the infeed accumulator 4 in a manner yet to be described, and can attend to the control of the operation of the machine.

Figure 2:
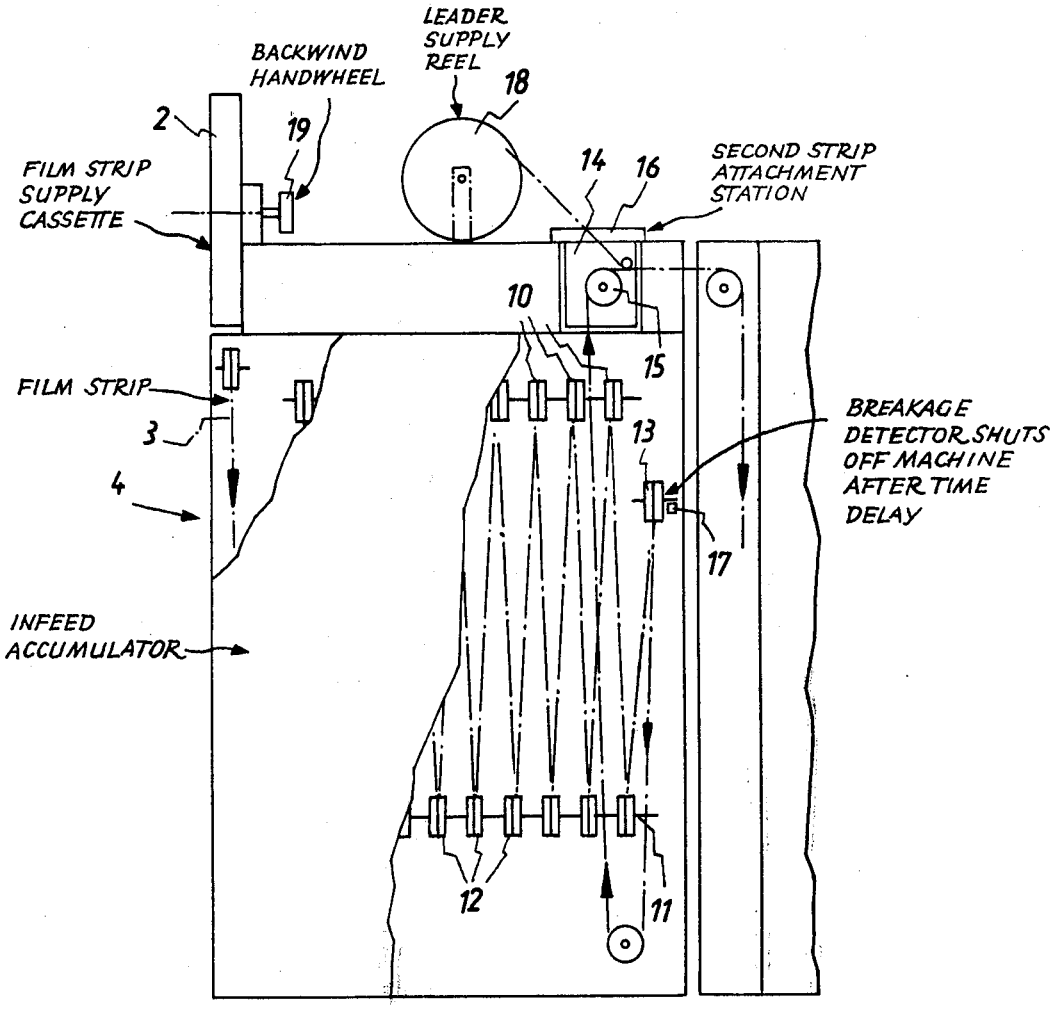
FIG. 2 is a side view of the machine of FIG. 1, as viewed looking along the arrow A in FIG. 1.

FIG. 2 depicts further details of the infeed accumulator 4 on a larger scale with parts broken away for visibility. The film strip 3 emerging from the closed supply cassette 2 passes through the first strip attachment station 7 (FIG. 1) and thence into the accumulator 4. Within the accumulator 4, the film strip 3 travels in long and winding path, being trained about upper guide rollers 10 and lower guide rollers 12. The upper rollers 10 are mounted for rotation at a fixed height. In contrast, the lower guide rollers 12 are mounted on a rod 11 which in turn is mounted so as to be raised and lowered in vertical direction. The infeed accumulator 4 additionally contains an end roller 13 about which the film strip 3 is trained on its way out of the accumulator 4 and into the light-tightly sealed second strip attachment station 14.

The second strip attachment station 14 is essentially comprised of a narrow box-shaped housing containing a guide roller 15, the housing being light-tightly closed off by means of a removable cover 16. This housing is provided with entrance and exit slits through which the film strip can enter and leave without the entrance of ambient light. Additionally, the entrance and exit slits are so designed that when the cover 16 is removed, the light which enters the interior of the second attachment station 14 does not penetrate either into the interior of the infeed accumulator 4 nor into the adjoining first one 5*a* of the processing fluid stages 5*a*–*5d*. Arranged at the second strip attachment station 14 is a leader strip supply reel 18 which swings up out of the top of the developing machine 1 for use when needed.

Inside the infeed accumulator 4, in the vicinity of the end roller 13, there is arranged a film breakage detector 17. When detector 17 senses the breakage of the strip within accumulator 14, it applies to a non-illustrated control arrangement a shut-off signal which shuts down the developing machine. The shut-down of the developing machine occurs with a time delay selected to correspond exactly to the time required for the trailing end of the broken film strip section to actually arrive at the second strip attachment station 14.

The machine of FIGS. 1 and 2 operates in the following manner.

Before the developing machine 1 was shut down, there was connected to the trailing end of the last film strip to be developed a leader strip. Accordingly, when the machine is in shut-down condition, a leader strip will extend all the way from the infeed station of the machine to the discharge station of the machine. When further film strips 3 are to be developed, a closed cassette 2 containing such film strips is inserted at the infeed station, and the leading end of the first such film strip is guided into the first strip attachment station 7 within which the trailing end of the leader strip is detained. The leading end of the film strip is spliced to the trailing end of the leader strip, and the first attachment station 7 is thereupon shut off from light. The developing machine 1 is now started up.

The leader strip pulls the film strip into and through the infeed accumulator 4, the processing fluid stages 5 and the drying stages 6 to the take-up reel device 9 of the discharge station of the machine. When the trailing end of the aforementioned leader strip, and accordingly the leading end of the first strip to be developed upon machine restart, reaches the take-up reel device 9, the operator disconnects the leader strip from the film strip and secures the latter to the take-up reel device 9 for collection. To facilitate this operation, there is advantageously provided between the last drying stage 6*b* and the take-up device 9 a (non-illustrated) outfeed accumulator similar to the infeed accumulator 4.

When the supply cassette 2 becomes emptied and the trailing end of the last film strip arrives at the first strip attachment station 7, non-illustrated means engages such trailing end and detains the trailing end at the attachment station 7. At the same time, a warning signal is generated, alerting the operator of the machine to the fact that a leader strip should be pulled off the leader supply reel 8 and spliced to the trailing end being detained at the attachment station 7. At its simplest, the operator may simply open up the housing of the first attachment station 7 and splice the leading end of a leader strip to the detained trailing end. Alternatively, the splicing operation could be performed by automatic means, or by semiautomatic means which performs the splicing operation under the step-by-step control of the machine operator.

While the trailing end of the last film strip 3 is being detained at the first attachment station 7, the feeding of strip into the processing stages 5 does not cease. Instead, the strip accumulated within infeed accumulator 4 begins to be fed into the processing stages 5. As this occurs, the rod 11 on which the lower guide rollers 12 of the accumulator 4 are mounted begins to rise, thereby shortening the length of the winding path for the strip material inside the accumulator. During the emptying of the accumulator 4 of its accumulated strip material, the operator will have ample time to effect the necessary splicing. Instead of splicing on a leader strip, the operator may remove the empty cassette 2, replace it with a new cassette 2, and splice on to the trailing end of the last film strip the leading end of a new film strip from the new cassette 2. In either event, when the splice has been made, the housing of the first attachment station 7 is closed shut, and the detained trailing end of the last film strip is released and permitted to enter the infeed accumulator 4, pulling the following strip in thereafter. As new strip material enters the infeed accumulator 4, the rod 11 carrying the lower guide rollers 12 descends, and the length of strip material contained within the accumulator 4 gradually returns to its full value.

As explained before, because of the provision of an infeed accumulator, a film strip defective in a way likely to cause it to break will most probably break within the infeed accumulator itself. If the strip within infeed accumulator 4 breaks, the film strip section downstream of the break continues to be pulled through the accumulator toward the processing stages of the developing machine. When the trailing end of the broken strip section passes over the end roller 13, it is sensed by the detector 17. The sensing of this trailing end by the detector 17 causes the developing machine 1 to shut down after the elapse of a time delay corresponding to the time required for the trailing end of the broken strip section inside accumulator 4 to arrive at the second strip attachment station 14. Additionally, the detector 17 effects the generation of a warning signal, alerting the operator of the machine to the fact that a splicing operation is to be performed at the second strip attachment station 14.

At its simplest, the splicing operation performed at second attachment station 14 can involve merely the opening of cover 16, the pulling of a leader off the swung-up leader supply reel 18, the splicing of the leader onto the trailing end of the broken strip section, the closing of the cover of the station 14, and the restarting of the developing machine 1. During the subsequent collection of the broken film strip section on take-up reel device 9, when the trailing end of the broken section emerges at the strip discharge station, the operator of the machine separates the film strip from the leader strip trailing thereafter and then shuts the machine 1 down again. The film strip section in accumulator 4 located upstream of the break is pulled back into the strip supply cassette 2 by means of a backwind handwheel 19. In preparation for the resumption of the developing process, the now empty infeed accumulator 4 is opened. Leader strip on the leader strip supply reel 18, the leading end of which is located at the discharge station of the machine, is pulled off the reel 18 to a sufficient extent and then cut. This cut trailing end of the leader strip is now inserted through the entrance slit at the bottom of the second strip attachment station 14 and threaded backward (i.e., upstream) through the interior of the infeed accumulator 4. This cut trailing end of the leader strip is fed all the way back to the first strip attachment station 7. The leading end of the broken film strip section pulled back into cassette 2 is now pulled out of the cassette again and spliced to the trailing end of the leader strip, at the first strip attachment station 7. The developing machine can then be started up again at once.

One of the advantages of the illustrated developing machine is that the machine can very readily be operated by a single operator. The juxtaposition of the infeed station and the discharge station, and the proximity of the first attachment station, the second attachment station, the leader supply reels, the infeed storage and the (non-illustrated) control panel for operating the developing machine, make it possible to effect all machine operations and correct most strip transport malfunctions from a single location at one end of the machine.

The warning signal which alerts the machine operator to the fact that a splicing operation is to be performed at second attachment station 14 is advantageously generated by the broken-end detector 17, as described above. However, because of the high strip transport speeds of modern developing machines, it can be advantageous to provide additional means for detecting film breakage as nearly immediately after the breakage as possible. For example, use can be made of spring-biased tension-sensing rollers operative for sensing film strip tension and, when the tension falls below a certain value, tripping a switch. If the occurrence of a film strip breakage in the accumulator 4 causes the rod 11 supporting the lower guide rollers 12 to descend, then the descending rod 11 can trip a switch to generate the warning signal. The earlier the generation of the warning signal, the more time the operator will have to ready himself to splice on a leader at second attachment station 14, and the shorter will be the time during which the developing machine need be shut down during the performance of such splicing operation at station 14.

The breakage detector 17 can be of any of a variety of types, such as electrical, magnetic, pneumatic or optical, in the latter event working with infrared or other light to which the film strips are not unacceptably sensitive. It has proved very advantageous to detect film breakage indirectly by detecting the drop in the rpm of the end roller 13. The very easily turned end roller 13 can be provided with metallic or ferrite members which turn past a stationary sensor thereby generating discrete pulses. The pulse-repetition frequency of the pulse train is readily correlatable with the rpm of the roller. When the rpm falls below a certain value, the developing machine is automatically shut off, again after an appropriate time delay, which in this event could be made a function of the film strip transport speed.

It will be understood that each of the elements described above, or two or more together, may also find a useful application in other types of constructions differing from the types described above.

While the invention has been illustrated and described as embodied in a continuously operating machine for developing still-photograph film strips spliced together to form a continuous strip, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a continuously operating developing machine for film strips of the type comprised of at least one processing fluid stage, at least one drying stage located downstream of the processing fluid stage and a discharge station located downstream of the drying stage, with film strips being guided connected one to the other through said stages and to said discharge station along a predetermined path, in combination, a first strip attachment station upstream of said stages provided with means for attaching the leading end of a new strip to the trailing end of a strip section which has already entered said path, an infeed accumulator located intermediate said first attachment station and said stages and provided with means for accumulating a length of strip being fed into said path so that strip can continue to be fed into said path during the detention of the trailing end of the strip in said accumulator at said first attachment station for attachment purposes, and a second strip attachment station intermediate said accumulator and said stages provided with means for attaching to the trailing end of a broken strip section leaving said accumulator the leading end of a leader strip so that as the trailing end of the broken strip section enters said path the leader strip will enter thereafter.

2. The developing machine of claim 1, the second strip attachment station including a light-tight container and a removable cover closing the container and being provided with light-tight entrance and exit slits for strip.

3. The developing machine of claim 1, there being provided at the second attachment station a supply reel for leader strip.

4. The developing machine of claim 1, the accumulator including sensing means for detecting the trailing end of a broken strip section travelling through the accumulator and in response to such detection shutting off the prime mover of the developing machine upon the elapse of a predetermined time delay.

5. The developing machine of claim 4, the accumulator including a plurality of guide rollers about which the strip is trained in a winding path, the accumulator additionally containing an end roller downstream of the guide rollers, the strip being trained about the end roller on its way out of the accumulator, the sensing means being located at the end roller.

6. The developing machine of claim 4, wherein the sensing means additionally comprises means operative in response to such detection for generating a signal alerting the operator of the machine to the fact of the strip breakage.

7. The developing machine of claim 4, the sensing means being responsive to the tension in the strip in the accumulator.

8. The developing machine of claim 4, the sensing means being responsive to the speed of rotation of a roller about which the strip in the accumulator is trained.

9. The developing machine of claim 1, the first attachment station, the infeed accumulator, the second attachment station, the processing fluid and drying stages, and the discharge station being arranged in a U-shaped layout so that the point of discharge of film strips out of the machine is located adjacent to the point of insertion of film strips into the machine, whereby a single operator can at a single location oversee the operation of the machine and control the feeding in of film strips and the winding up of discharged film strips.

10. The developing machine of claim 9, wherein the second attachment station is located adjacent the point of discharge of film strips out of the machine and the point of insertion of film strips into the machine, whereby the single operator can at the same location additionally control the attachment of leader strips to broken film strip sections at the second attachment station.

11. A method of effecting the transport of film strips and leader strips through a continuously operating developing machine of the type comprised of at least one processing fluid stage, at least one drying stage located downstream of the processing fluid stage, a discharge station located downstream of the drying stage, a first strip attachment station upstream of said stages, an infeed accumulator intermediate said first attachment station and said stages, and a second strip attachment station intermediate said accumulator and said stages, the method comprising the steps of guiding film strips connected one to the other through said stages and to the discharge station along a predetermined path, at said first attachment station attaching to the trailing end of a strip which extends through said accumulator and which has already entered said path the leading end of a new strip and during such attachment detaining such trailing end at said first attachment station, during the detention of such trailing end at said first attachment station letting accumulated strip inside the infeed accumulator feed into said path, upon the completion of the attachment operation at said first attachment station permitting the trailing end of the strip in the accumulator to enter the accumulator and then accumulating a new accumulation of strip within the accumulator, when a strip in the accumulator breaks taking the trailing end of the broken strip section as such trailing end is leaving the accumulator and attaching thereto the leading end of a leader strip, and feeding the trailing end of such broken strip section into said path with the leader strip attached thereto entering thereafter.

12. The method of claim 11, further including detecting the trailing end of a broken strip section within the accumulator using a detecting device operative for generating a signal and utilizing the signal to deactivate the prime mover of the machine after a predetermined time delay corresponding to the time required for the trailing end of the broken strip section to reach the second strip attachment station.

13. The method of claim 11, the detecting comprising detecting the tension in the strip contained in the accumulator.

14. The method of claim 11, the detecting comprising detecting the rotary speed of a roller about which the strip contained in the accumulator is trained.

* * * * *